US006178896B1

(12) United States Patent
Houk, Jr. et al.

(10) Patent No.: US 6,178,896 B1
(45) **Date of Patent: *Jan. 30, 2001**

(54) SHELVING SYSTEM

(75) Inventors: David A. Houk, Jr., Norton; Kenneth W. Hull; John Vura, both of Wooster, all of OH (US)

(73) Assignee: Rubbermaid Incorporated, Wooster, OH (US)

( * ) Notice: Under 35 U.S.C. 154(b), the term of this patent shall be extended for 0 days.

This patent is subject to a terminal disclaimer.

(21) Appl. No.: 09/518,151

(22) Filed: Mar. 2, 2000

Related U.S. Application Data

(63) Continuation-in-part of application No. 09/085,389, filed on May 26, 1998, now Pat. No. 6,079,339.

(51) Int. Cl.[7] ..... A47B 96/02

(52) U.S. Cl. ..... 108/186; 108/157.13; 211/186

(58) Field of Search ..... 108/901, 186, 108/190, 149, 151, 156, 157.13, 159, 158.11, 193; 211/186, 188

(56) References Cited

U.S. PATENT DOCUMENTS

| | | | |
|---|---|---|---|
| D. 245,744 | | 9/1977 | Brooks . |
| D. 249,618 | | 9/1978 | Oxenhandler . |
| D. 330,652 | | 11/1992 | Goetz . |
| D. 330,819 | | 11/1992 | Dickinson . |
| D. 344,382 | | 2/1994 | Conaway et al. . |
| D. 347,131 | | 5/1994 | Wolff . |
| D. 362,138 | | 9/1995 | Sagol . |
| D. 384,226 | | 9/1997 | Goetz . |
| D. 385,132 | | 10/1997 | Sagol . |
| 3,053,558 | | 9/1962 | Challas, Jr. et al. . |
| 3,669,033 | | 6/1972 | Murcia . |
| 3,734,032 | | 5/1973 | Kovacik . |
| 3,788,242 | | 1/1974 | Hassel et al. . |
| 4,099,472 | | 7/1978 | Kellogg . |
| 4,145,977 | | 3/1979 | Yellin . |
| 4,467,927 | | 8/1984 | Nathan . |
| 4,574,709 | * | 3/1986 | Kitts ..... 211/188 X |
| 4,593,825 | | 6/1986 | Hepp . |
| 4,615,278 | | 10/1986 | Cabrelli . |
| 4,621,740 | | 11/1986 | Lang . |
| 4,706,576 | | 11/1987 | James . |
| 4,843,975 | | 7/1989 | Welsch et al. . |
| 4,852,501 | | 8/1989 | Olson et al. . |
| 4,940,150 | | 7/1990 | Spengler . |
| 4,953,719 | | 9/1990 | Spamer . |
| 4,989,519 | | 2/1991 | Welsch et al. . |
| 4,998,023 | * | 3/1991 | Kitts ..... 211/188 X |
| 5,158,187 | | 10/1992 | Taub . |
| 5,303,645 | | 4/1994 | Meacham . |
| 5,588,541 | * | 12/1996 | Goetz ..... 211/188 |
| 5,683,004 | | 11/1997 | Aho . |
| 5,709,158 | | 1/1998 | Wareheim . |
| 5,752,610 | | 5/1998 | Remmers . |

OTHER PUBLICATIONS

Photograph of packaging, Shelving system; Plano Molding Company, 431 East South Street, Plano, Illinois 60545. Published at least as early as Mar., 1998.

P. 17, Shelving system; Contico International, Inc., 1101 Warson Road, St. Louis, Missouri 63132. Publication date 1992.

Catalog page, Shelving system; Rubbermaid Incorporated, 1147 Akron Road, Wooster, Ohio 44691. Publication date 1997.

* cited by examiner

*Primary Examiner*—Janet M. Wilkens
(74) *Attorney, Agent, or Firm*—Foley & Lardner

(57) ABSTRACT

A shelving system is disclosed. The shelving system includes a panel having a longitudinal direction and a transverse direction. The panel includes at least one socket. The socket is disposed on the panel and includes an inner wall and an outer wall circumscribing the socket inner wall. The outer wall is distanced from the inner wall. A floor member is coupled to the inner wall and the outer wall and is disposed generally parallel relative to the panel. The socket is adapted to transmit stresses along the floor member.

19 Claims, 7 Drawing Sheets

SHELVING SYSTEM

RELATED APPLICATIONS

The present application is a continuation of U.S. patent application ser. No. 09/085,389 titled "SHELVING SYSTEM", filed on May 26, 1998, and issued as U.S. Pat. No. 6,079,339, which is incorporated by reference herein.

BACKGROUND OF THE INVENTION

It is well known in the art to provide shelving. Commonly, such shelving systems include a plurality of rectangular panels having four sockets integrally formed in the comers of the panels. Each successive panel is connected to an adjacent panel by four posts receivable within the sockets. Although such devices perform adequately, such devices could be improved upon. Specifically, shelving of the above mentioned character often do not provide sufficient resiliency to deformation. Once the shelving is loaded, such shelving often allows for stresses to concentrate in the region surrounding each of the sockets. Secondly, once loaded not only are stresses concentrated in the regions surrounding each of the sockets, but strain often concentrates towards the geometric center of each panel. Accordingly, such panels often bow once loaded. Together, the above described deficiencies reduce the maximum load that such shelving is capable of withstanding. If the maximum load is exceeded, the shelving may ultimately fail.

In order to overcome some of the above disadvantages other shelving devices have been suggested. For instance, U.S. Pat. No. 5,709,158 to Wareheim discloses providing shelving having a beam structure disposed around the periphery of the panel and a beam disposed along the median portion of the panel. Wareheim also discloses providing a plurality of diagonally oriented vertical braces.

Although the device to Wareheim advances the art, Wareheim has also been found to have several deficiencies. Specifically, the beam structure of Wareheim may increase the structural rigidity of such panel members. However, the beam structure is substantially linear in shape. In contrast, the strain realized within each panel is commonly nonlinear. With a linear distribution of material, some regions may have an insufficient amount of rigidity due to an insufficient amount of material disposed within a particular region. Similarly, other regions of the panel may have adequate rigidity with an optimum amount of material usage. While still other regions may prove to have an necessarily high amount of rigidity with a corresponding waste of material. In summary, a linear distribution of material is an inefficient use of material within such panels.

A second disadvantage found in the device to Wareheim is that stresses are allowed to concentrate adjacent each of the sockets. Although the diagonally disposed vertical support ribs assist in reducing the stress concentration, a substantial amount of stresses are still allowed to concentrate in this region thereby limiting the load capable of being applied to such panels or requiring additional material to be added around such sockets.

Accordingly, one skilled in the art can appreciate that several advances could still be made in the art. Specifically, it would be desirable to have a shelving system that reduces the strain realized within each panel. It would be desirable to have a panel which optimizes material usage thereby providing a shelving system which is capable of bearing a maximum load while also requiring a minimum amount of material. It would further be desirable to reduce the stresses realized adjacent each of the socket members.

SUMMARY OF THE INVENTION

It is an object of this invention to provide a shelving system having a plurality of molded panels.

It is a further object of this invention to provide a panel having increased rigidity thereby reducing strain and the corresponding deformation of the panel.

It is still a further object of this invention to provide a panel which maximizes structural rigidity while also minimizing the amount of material usage.

It is an additional object of this invention to provide a panel which distributes stresses adjacent each of the socket members.

In accordance with a preferred embodiment of this invention, these and other objects and advantages are accomplished as follows.

The present invention provides a shelving system having at least one panel. The panel has a longitudinal direction and a transverse direction transverse relative to the longitudinal axis. The panel further includes a plurality of rails. The plurality of rails includes at least a first rail member and a second rail member. The first rail member and the second rail member each have an upper portion extending downward a depth from the panel. One novel aspect of this invention is that the second rail has a depth approximately greater than the depth of the first rail.

Additionally, each rail of the plurality of rails includes a lower portion, the lower portion of each rail extends downward away from said upper portion. Preferably, the lower portion terminates at a curvilinear lower edge. Preferably, the curvilinear lower edge has a parabolic shape. However, one skilled in the art can best appreciate that the lower peripheral edge of this invention may have various other shapes without departing from the novel aspects of this invention.

Further, this invention includes at least one socket disposed on each panel. Each socket includes a plurality of walls. Preferably, the socket includes at least an inner wall and an outer wall circumferentially disposed around the inner wall. The socket includes at least one support member disposed between the inner wall and the outer wall. Preferably, the support member is at least one reinforcement flange. In addition, the socket also preferably includes a floor member disposed between the inner wall and the outer wall in a parallel orientation relative to the panel. Lastly, the shelving system of this invention includes a plurality of posts. Each post preferably having a bottom portion and a top portion each being receivable within a corresponding socket.

The above disclosed shelving system provides several advantages. As best appreciated by one skilled in the art, several panels may be interconnected together to form the shelving system. The number of panels may be determined by the requirements of a particular user or the constraints experienced in a particular environment. Accordingly, the user of this invention is provided with a substantial amount of versatility.

Another advantage found in this invention is that strains realized within the structure may be minimized while also reducing overall material usage. The strains realized with a particular panel are reduced by placing additional material in regions which experience greater strain. In shelving, strain is commonly concentrated at the geometric center of each panel. Accordingly, this invention reduces strain while reducing material usage by concentrating additional material towards the geometric center of each panel. Specifically, this advantage is achieved through the novel rail structure of this invention.

This invention contemplates use of at least a first rail and a second rail. The first rail member of this invention has an upper portion having a first depth and a second rail member having a second depth. Accordingly, the second rail may be placed at a location which experiences greater strain whereas the first rail may be positioned in a location which experiences lesser strain. Further, each rail has a lower portion having a generally curvilinear lower edge having a vertex. Accordingly, a greater amount of material is concentrated at the vertex once again reducing strain proximate the vertex w while also reducing material usage at other regions which do not experience such strain.

Another advantage of the present invention is that this device disperses stresses proximate the socket members. The shelving system of this device includes an inner wall surrounded by an outer wall. The outer wall is interconnected to the inner wall by a plurality of support members and a floor member. Stresses realized within the panel are communicated into the outer wall. From the outer wall the stresses are communicated into the inner wall. Finally, the inner wall in turn communicates the stresses into the corresponding post. Accordingly, the panel of this invention provides greater durability while also reducing the amount of material necessary.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE INVENTION

Figure 1:
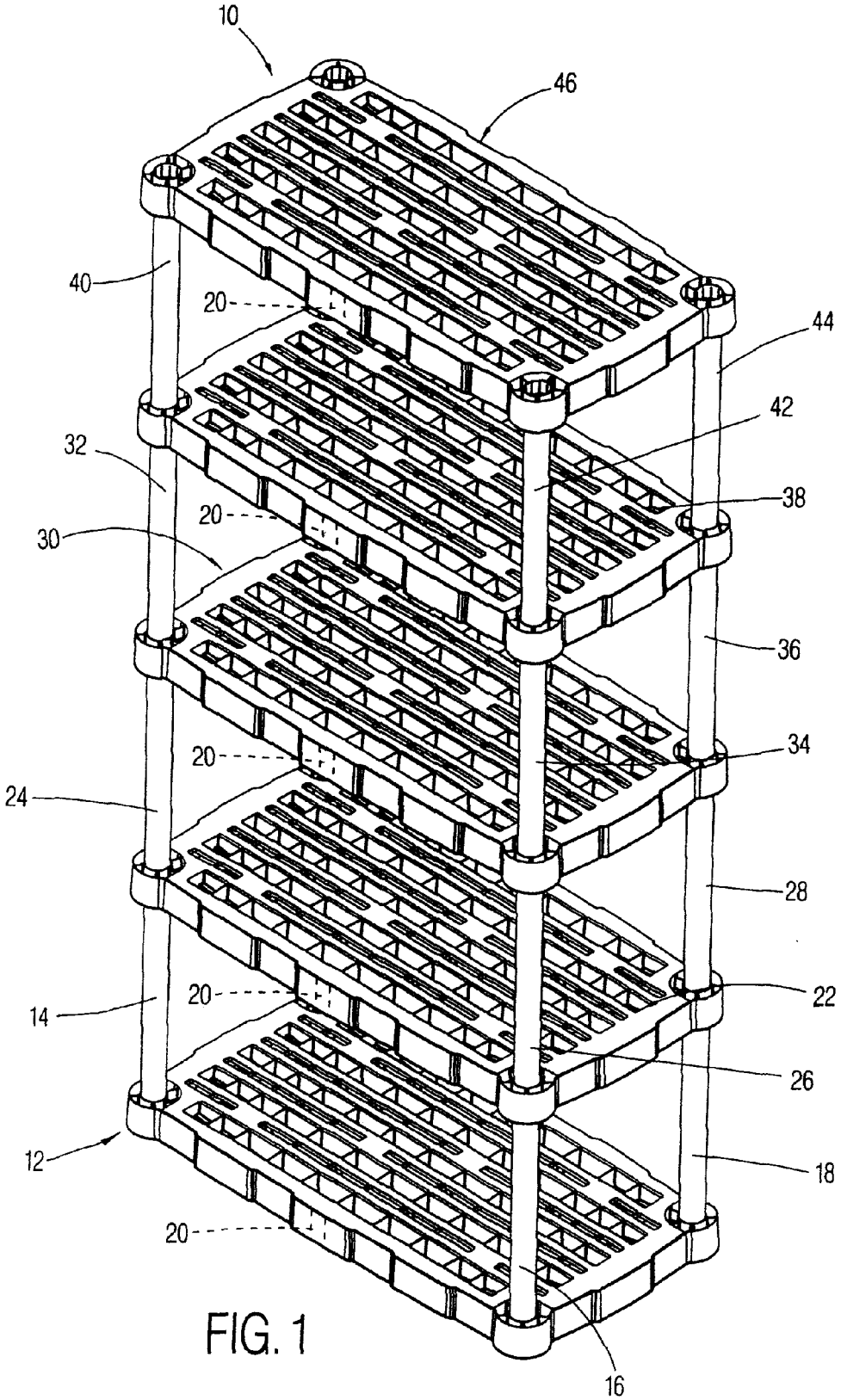
FIG. 1 shows a perspective view of a shelving system of this invention.

As best appreciated with reference to FIG. 1, the present invention provides a shelving system (10) having a modular structure. The shelving system (10) includes a plurality of panels and a plurality of posts interconnecting the panels. Preferably, the plurality of panels is a first panel (12) having a first post (14), second post (16), third post (18) and a fourth post, not shown, each extending upward away from the first panel (12) . Next, a second panel (22) is disposed on top of the first post (14), second post (16), third post (18) and fourth post (20). Then a fifth post (24), sixth post (26), seventh post (28), and eighth post, not shown, is disposed on top of the second panel (22). A third panel (30) is disposed over the fifth post (24), sixth post (26), seventh post (28) and eighth post, not shown. Then a ninth post (32), tenth post (34), eleventh post (36), and twelfth post, not shown, is disposed over the third panel (30). A fourth panel (38) is then placed over the ninth post (32), tenth post (34), eleventh post (36) and twelfth post, not shown. Then a thirteenth post (40), fourteenth post (42), fifteenth post (44), and sixteenth post, not shown, is disposed on top of the fourth panel (38). Lastly, a fifth panel (46) is disposed on top of the thirteenth post (40), fourteenth post (42), fifteenth post (44) and a sixteenth post, not shown. One skilled in the art can best appreciate that the above described shelving system is described in terms of a preferred embodiment and that the teachings of the instant invention may be applied to shelving systems which utilize either a greater number or lesser number of panels. Furthermore, one skilled in the art can best appreciate that the terms upper, lower, bottom, top, as used herein are merely used for clarification purposes and are not intended to be used to in anyway limit the scope of this invention.

Figure 2:
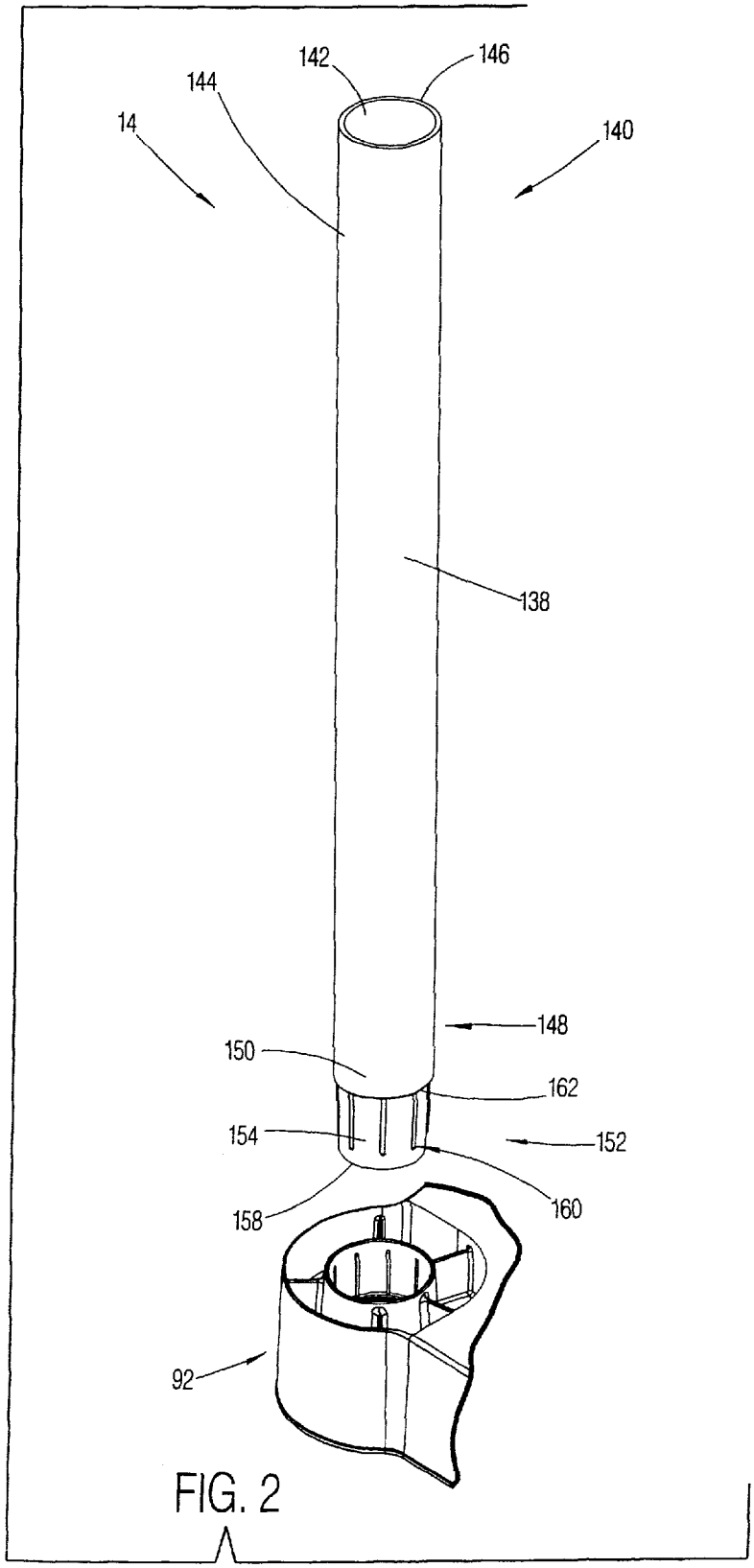
FIG. 2 shows a fragmentary exploded view of a first post and a first socket of a first panel of the shelving system.
Figure 3:
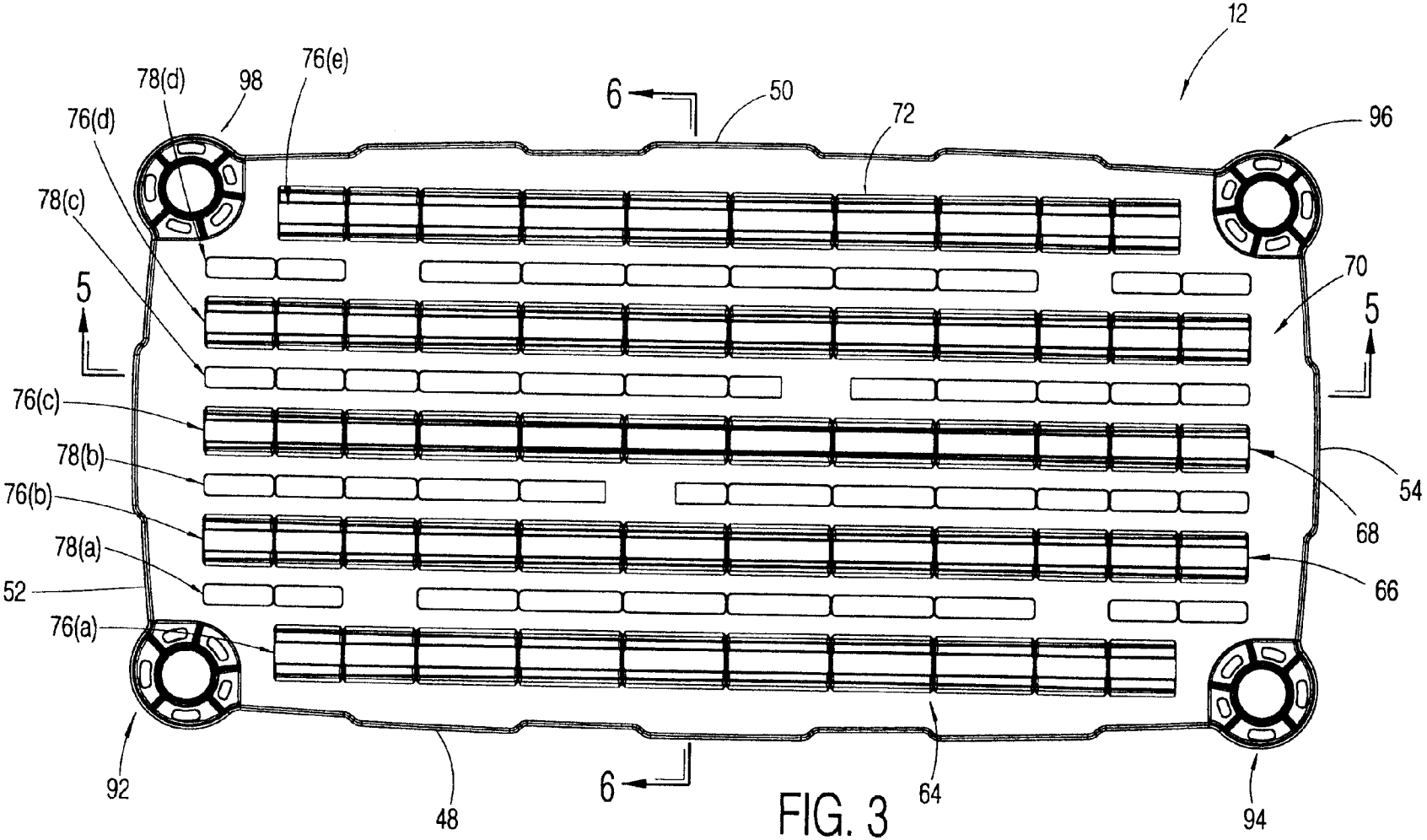
FIG. 3 shows a top plan view of the first panel.
Figure 3A:
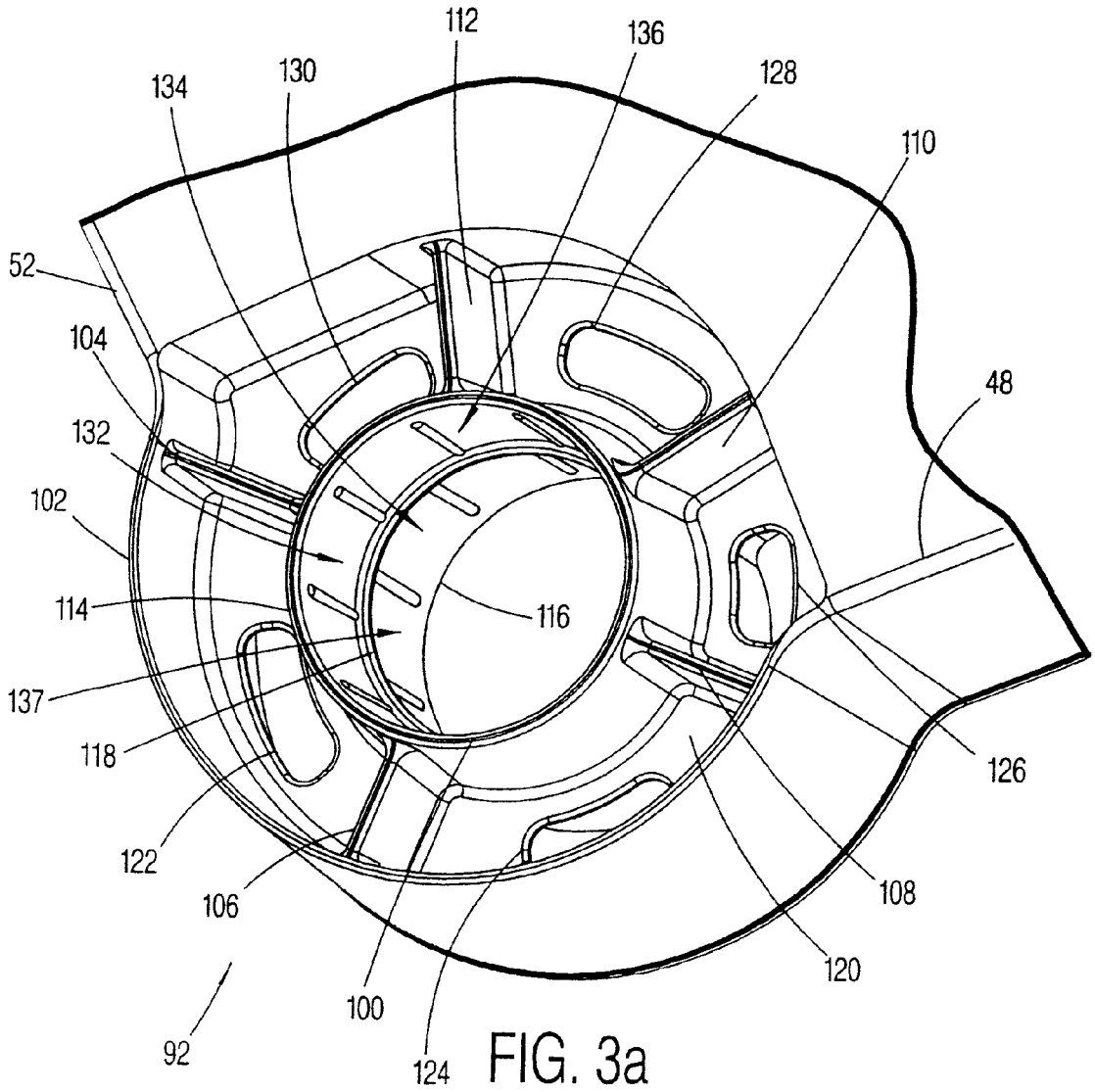
FIG. 3*a* shows a fragmentary view of the first socket of the first panel.
Figure 4:
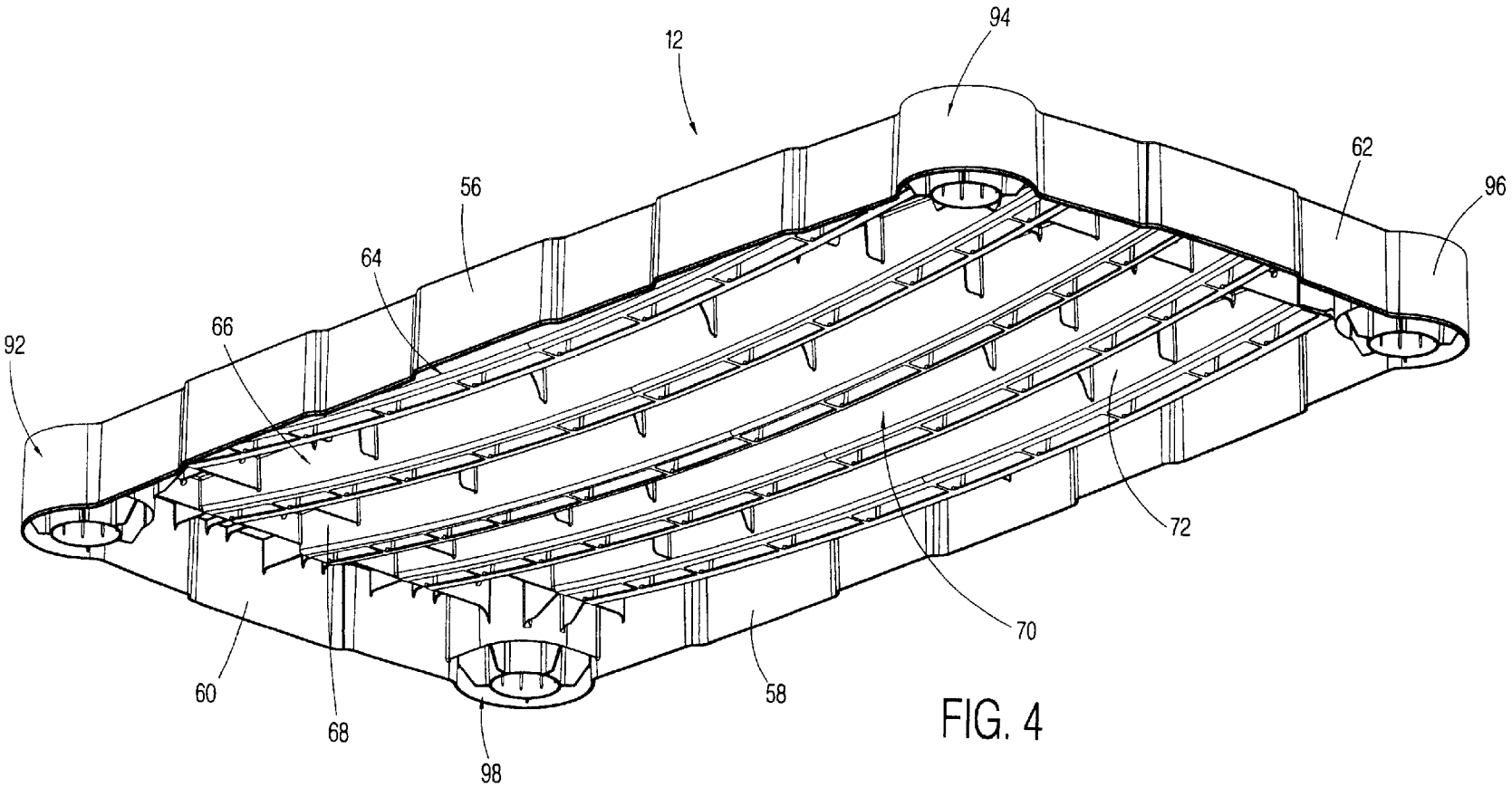
FIG. 4 shows a bottom perspective view of the first panel of this invention.

With particular reference to FIGS. 2, 3*a* and 4, the first panel (12) is described in detail. However, it should be understood that the second panel (22), third panel (30), fourth panel (38) and fifth panel (46) has a similar construction as the first panel (12). The first panel (12) has a longitudinal direction and a transverse direction. The transverse direction being transverse relative to the longitudinal direction. The first panel (12) includes one longitudinal edge (48) and another longitudinal edge (50) oppositely disposed relative to the one longitudinal edge (48) in the transverse longitudinal direction. The first panel (12) further includes a one side edge (52) and another side edge (54). The another side edge (54) being oppositely disposed relative to the one side edge (52) along the longitudinal direction. The first panel (12) further includes one longitudinal skirt (56) depending from the one longitudinal edge (48), and another longitudinal skirt (58) depending from the another longitudinal edge (50), one side skirt (60) depending from the one side edge (52), and another side skirt (62) depending from the another side edge (54).

The first panel (12) of this invention further includes a plurality of rails. Preferably, the plurality of rails is a first rail (64) disposed adjacent the one longitudinal skirt (56) and extending in the longitudinal direction of the first panel (12). Extending adjacent to the first rail (64) is a second rail (66) disposed in the longitudinal direction of the first panel (12). Extending adjacent to the second rail (66) is a third rail (68) disposed in the longitudinal direction of the first panel (12). Next, a fourth rail (70) is disposed adjacent to the third rail (68) and extends in the longitudinal direction of the first panel 12). Lastly, a fifth rail (72) is disposed adjacent the fourth rail and extends in the longitudinal direction of the first panel (12). Although the plurality of rails as described above preferably discloses five rails oriented in the longitudinal direction of the first panel (12), either more or less rails may be utilized or various other orientations of the rails rather than in the longitudinal direction may be employed without departing from the novel aspects of this invention.

Figure 6:
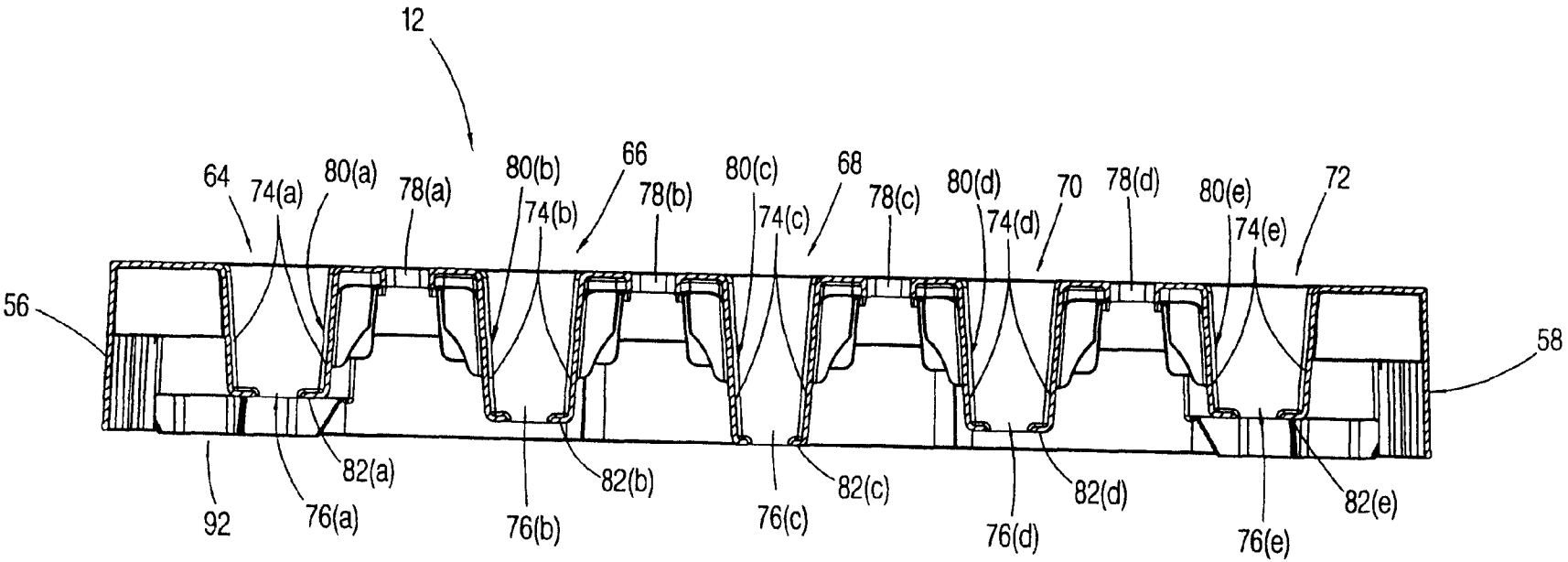
FIG. 6, shows a side cross-section view of the first panel cut along lone 6—6 of FIG. 3.

As seen in FIG. 6, each rail of the plurality of rails includes a pair of opposed faces having a plurality of holes disposed along the length of each rail of the plurality of rails. As seen in FIG. 6, the first rail (64) has a pair of opposed faces (74*a*) having a plurality of holes (76*a*) disposed therethrough. The second rail (66) has a pair of opposed faces (74*b*) having a plurality of holes (76*b*) disposed therethrough. The third rail (68) has a pair of opposed faces (74*c*) having a plurality of holes (76*c*) disposed therethrough. The fourth rail (70) has a pair of opposed faces (74*d*) having a plurality of holes (76*d*) disposed therethrough. Lastly, the fifth rail (72) has a pair of opposed faces (74*e*) having a plurality of holes (76*e*) disposed therethrough.

The first panel (12) further includes a plurality of openings. Specifically, the first panel (12) has a plurality of openings (78*a*) between the first rail (64) and second rail (66), a plurality of openings (78*b*) between the second rail (66) and the third rail (68), a plurality of openings (78*c*) between the third rail (68) and the fourth rail (70), and a plurality of openings (78*d*) between the fourth rail (70) and the fifth rail (72).

Figure 5:
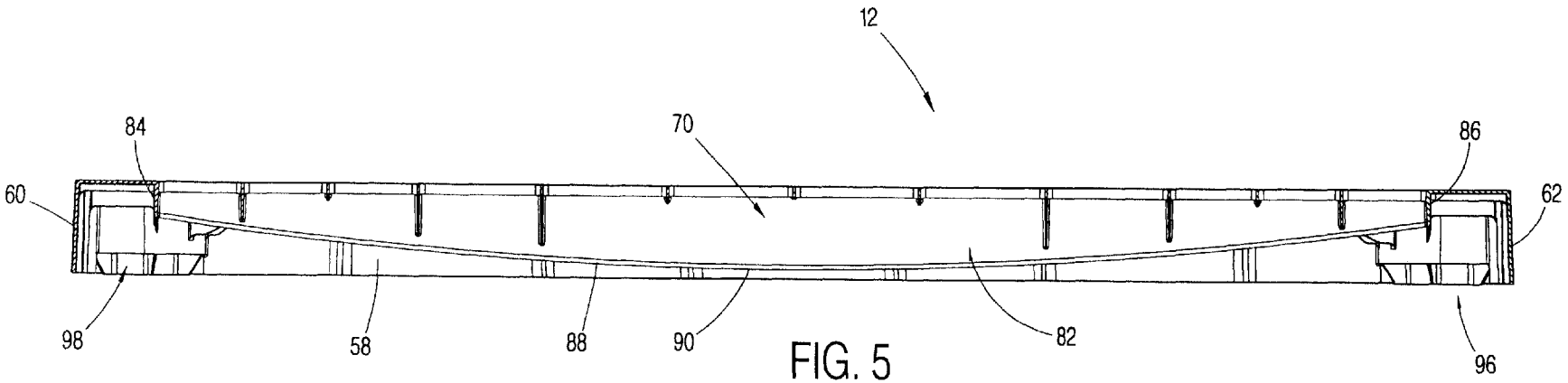
FIG. 5, shows a front cross-section view of the first panel cut along line 5—5 of FIG. 3.

FIG. 4 and FIG. 5 shows the fourth rail (70) of this invention. However, it should be understood that the unique aspects as shown with reference to the fourth rail (70) apply equally to the first rail (64), the second rail (66), the third rail (68), and the fifth rail (72). The fourth rail (70) has one end (84) disposed proximate to the one side edge (52) of the first panel (12). The fourth rail (70) includes another end (86) disposed proximate the another side edge (54) of the first panel (12). The fourth rail (70) further includes a fourth upper portion (80*d*) and a fourth lower portion (82). The fourth upper portion (80*d*) is preferably disposed adjacent the first panel (12). The fourth lower portion (82) is preferably disposed adjacent the fourth upper portion (80*d*). Preferably, the fourth upper portion (80*d*) and the fourth lower portion (82) are integrally formed with the first panel (12). However, one skilled in the art can appreciate that various other attachment mechanisms may be equivalently employed in practicing this invention.

Preferably, as shown in FIG. 6, the fourth upper portion (80*d*) is globally rectangular in shape and bounded by the first panel (12), the one end (84), the another end, and a chord, not shown, interconnecting the fourth upper portion (80*d*) and the fourth lower portion (82). The first upper portion (80*a*) has a first depth measured from the first panel (12) to the chord, not shown. Ideally, as best appreciated with reference to FIG. 6, the depth of the second upper portion (80*b*) on the second rail (66) is approximately greater than the depth of the first upper portion (80*a*). The depth of the third upper portion (80*c*) of the third rail (68) is approximately greater than the depth of the second upper portion (80*b*) of the second rail (66). The depth of the fourth upper portion (80*d*) of the fourth rail (70) is approximately less than the depth of the third upper portion (80*c*). The depth of the fifth upper portion (80*e*) is approximately less than the depth of the fourth upper portion (80*d*). Most preferably, the depth of the first upper portion (80*a*) is approximately equal to the depth of the fifth upper portion (80*e*), and the depth of the second upper portion (80*b*) is approximately equal to the depth of the fourth upper portion (80*d*).

Another unique aspect regarding the plurality of rails may be best appreciated with reference to FIGS. 5 and 6. The fourth lower portion (82) of the fourth rail (70) has a curvilinear lower edge (88). Preferably, the curvilinear lower edge (88) is parabolic in shape having a vertex (90). Most preferably the vertex (90) is disposed at approximately a midpoint between the one end (84) and the another side end (86). However, one skilled in the art can best appreciate that the material usage as described above regarding the novel rail structure of this invention disposes the maximum amount of material at approximately the geometric center of each panel and smoothly tapers towards the one longitudinal edge (48), the another longitudinal edge (50), the one side edge (52), and the another side edge (54) of each panel. Similarly, it has been found that the strain distribution in each panel has approximately the same distribution.

Each panel of this invention includes a plurality of sockets. As best appreciated with reference to FIG. 4, the first panel (12) preferably includes a first socket (92) disposed proximate the one longitudinal edge (48) and one side edge (52), a second socket (94) disposed proximate the one longitudinal edge (48) and another side edge (54), a third socket (96) disposed proximate the another longitudinal edge (50) and the another side edge (54), and a fourth socket (98) disposed proximate the another longitudinal edge 50) and the one side edge (52). Preferably, the second panel (22), the third panel (30), the fourth panel (38), and the fifth panel (46) each have four sockets similarly disposed.

The unique socket of this invention is best appreciated with reference to the first socket (92) as shown in FIG. 3*a*. The first socket (92) includes an inner wall (100) and an outer wall (102) circumferentially disposed around said inner wall (100). Preferably, the inner wall (100) and outer wall (102) are each approximately cylindrical in shape. The inner wall (100) is interconnected to the outer wall (102) by a plurality of support members. Preferably, the support members are a first support member (104), a second support member (106), a third support member (108), a fourth support member (110), and a fifth support member (112). Each of the support members are radially disposed around the circumference of the inner wall (100). The inner wall (100) has a upper edge (114) and an oppositely disposed lower edge (116). Disposed between the upper edge (114) and the lower edge (1 16) is a circumferential lip (118). In addition, a floor member (120) is disposed between the inner wall (100) and the outer wall (102). Preferably, the floor member (120) is parallelly oriented relative to the first panel (12). Most preferably, the floor member (120) is disposed at approximately at a midpoint between the upper edge (114) and the lower edge (116) of the inner wall (100). The floor member in another preferred embodiment includes a first opening (122) disposed between the first support member (104) and the second support member (106), a second opening (124) between the second support member (106) and the third support member (108), a third opening (126) between the third support member (108) and fourth support member (110), a fourth opening (128) between the fourth support member (110) and the fifth support member (112), and a fifth opening (130) between the fifth support member (112) and the first support member (104). The inner wall (100) has an upper portion (132) and a lower portion (134). The upper portion has a plurality of upper ribs (136). Similarly, the lower portion has a plurality of lower ribs (160). In a preferred embodiment, the panel (12) preferably includes at least one gusset, not shown, interconnecting at least one of the sockets (92, 94, 96, or 98) to at least one of the skirts (56, 58, 60 or 62).

As best appreciated with reference to FIG. 2, this invention utilizes a plurality of posts. Specifically, as shown in FIG. 2, the first post (14) includes a shaft (138) having a top portion (140). The top portion (140) includes a top inner surface (142) and outwardly disposed top outer surface (144). The top portion (140) terminates at a top peripheral edge (146). Oppositely disposed along the shaft (138) relative to the top portion (140) is a bottom portion (152). The bottom portion (152) includes a bottom outer surface (154) and a bottom inner surface, not shown, inwardly disposed relative to the bottom outer surface (154). The bottom portion (152) terminates at a bottom peripheral edge (158). Preferably, the bottom outer surface (154) includes a plurality of post ribs (160) radially disposed around said bottom outer surface (154). Additionally, the first post (14) includes a lower portion (148) adjacent the bottom portion (152). The lower portion (148) includes a lower outer surface (150). Preferably, a post shoulder (162) is disposed between the bottom portion (152) and the lower portion (148). In a preferred embodiment, each post of the plurality of posts is cylindrical in cross-section. However, various other crosssections could be utilized without departing from the novel aspects of this invention. One skilled in the art can appreciate the above described structure with particular reference to the first post (14) is equivalently applicable to the structure of all of the plurality of posts.

In use, the user of this invention may insert a post within a particular socket. As seen in FIG. 2, the first post (14) is insertable within the first socket (92). The user will depress the first post (14) into the socket (92) until the post shoulder (162) abuts the circumferential lip (118). Once the first post (14) is so oriented the lower outer surface (150) securely abuts against the upper portion (132) of the inner wall (100). Similarly, the second post (16) is inserted into the second socket (94); the third post (18) is inserted into the third socket (96); the fourth post (20) is inserted into the fourth socket (98). Next, the second panel (22) is inserted onto each of the posts (14, 16, 18, and 20). Specifically, the top portion (140) of the first post (14) is inserted into the lower portion (134) of the first socket (92) of the second panel (22). Similarly, the second post (16) is inserted into the second socket (94); the third post (18) is inserted into the third socket (96); and the fourth post (20) is inserted into the fourth socket (98). If it is desired for the shelving system to have an additional shelf, the fifth post (24) may be inserted into the first socket (92) of the second panel (22), the sixth post (26) may be inserted into the second socket (94) of the second panel (22); the seventh post (28) may be inserted into the third socket (96) of the second panel (22); and the eighth post, not shown, may be inserted into the fourth socket (98) of the second panel (22). Specifically, with particular reference merely to the fifth post (24), the fifth post (24) is inserted into the first socket (92) until the post shoulder (162) of the fifth post (24) abuts the circumferential lip (118) of the first socket (92) of the second panel (22). In addition, the bottom outer surface (154) of the fifth post (24) is receivable within the top inner surface (142) of the first post (14). Accordingly, additional support is provided to the shelving system (10) of this invention. The preferred embodiment of this invention discloses a shelving system (10) having five panels interconnected by a plurality of posts. However, one skilled in the art can appreciate that support structures may be assembled having either more or less panels than the number of panels specifically disclosed herein Without departing from the novel aspects of this invention.

One advantage of the above disclosed invention is that the panels of this invention utilize a plurality of rails to minimize strains realized within each panel while also minimizing the amount of material necessary. This advantage is achieved by uniquely placing the additional material in locations where strain is maximized in each panel. This advantage is achieved by two separate mechanisms: varying the depth of each different rail and varying the amount of material disposed along each rail. Preferably, the amount of material is thereby maximized at the geometric center of each panel. The geometric center exhibits the greatest amount of strain within each panel once loaded. However, to minimize the amount of material utilized excess material is removed from those regions which experience lesser strain. One skilled in the art can appreciate that various other embodiments of this invention may be utilized. For instance, the rails may be oriented in a transverse direction rather than along the longitudinal direction or even along a direction skewed relative to the longitudinal direction or the transverse direction. In addition, if in a particular application it is found the strain distribution differs from that disclosed above, the novel rail structure of this invention may be similarly modified to once again dispose the maximize amount of material in regions proximate the regions which experience maximum strain and minimize the material usage in regions which experience minimum strain.

Another advantage taught by this invention is the utilization of a novel socket structure. As seen in FIG. 3*a*, the socket (92) of this invention reduces stresses in the region surrounding the socket (92). The stresses realized around the socket (92) is transmitted through the outer wall (102) radially inward along the floor member (120) and the plurality of support members (104, 106, 108, 110, 112) into the inner wall (100). The inner wall (100) in turn transmit the stresses into the first post (14). Accordingly, the novel socket structure of this invention reduces the likelihood of failure in the region surrounding each socket.

Still another advantage of this invention is the unique placement of the floor member within each socket. As shown in FIG. 3*a*, the floor member (120) of the first socket (92) is disposed at approximately the midpoint between the upper edge (114) and the lower edge (116). This location of the floor member (120) is uniquely positioned for use in molded plastic shelving. In fabricating molded plastic shelving, each panel is integrally formed with a plurality of sockets and rails. This operation is performed by the interface of two metal die elements which are forced together defining the other boundaries of the panel. Once forced together, the cavity defined therein is injected with a plastic material. Next, the dies are cooled to set the molded panel. However, those skilled in the art can appreciate that in order to form deep depressions in a mold requires a die having a metal portion which extends a greater distance inward into the cavity from one of the dies. However, use of a die having a metal portion which extends a greater distance into the mold may present cooling problems since a greater surface area of the metal die needs to be cooled. Accordingly, the present invention places the floor member at approximately the midpoint of the socket thus allowing for optimum cooling from both dies and minimizing the surface area of either of the dies.

While this invention has been described in terms of a preferred embodiment, it is apparent that other forms could be adopted by one skilled in the art, for example by modifying the appearance or structure of the panel, or by substituting appropriate materials. Accordingly, the scope of this invention is to be limited only by the following claims.

What is claimed is:

1. A shelving system comprising:

a panel having a longitudinal direction and a transverse direction, said panel including at least one socket, said socket being disposed on said panel, said socket including:

an inner wall and outer wall circumscribing said socket inner wall, said outer wall being distanced from said inner wall; and a floor member coupled to said inner wall and said outer wall, the floor member being disposed generally parallel relative to the panel, wherein the socket is adapted to transmit stresses along the floor member.

2. A shelving system as recited in claim 1, wherein said socket further includes a plurality of radially extending support members disposed between said inner wall and said outer wall of said socket.

3. A shelving system as recited in claim 2, wherein said plurality of support members normally intersect said outer wall and said inner wall.

4. A shelving system as recited in claim 1, wherein said inner wall has an upper edge and an oppositely disposed lower edge, said floor member is disposed at approximately a midpoint between said upper edge and said lower edge.

5. A shelving system as recited in claim 4, wherein said inner wall further includes an upper portion adjacent said upper edge, and a lower portion adjacent said lower edge.

6. A shelving system as recited in claim 5, wherein said panel further includes at least one post member receivable within said socket.

7. A shelving system as recited in claim 6, wherein said post comprises:

a top portion having a top inner surface and a top outer surface, said top portion terminates at a top peripheral edge; and a bottom portion oppositely disposed relative to said top portion, said bottom portion having a bottom inner surface and an outwardly disposed bottom outer surface, said bottom portion terminating at a bottom peripheral edge, said post further including a lower outer bottom surface disposed adjacent said bottom outer surface.

8. A shelving system as recited in claim 7, wherein said top outer surface of said top portion has a first radius approximately equal to a second radius of the lower portion of said socket, said bottom outer surface having a third radius approximately equal to a fourth radius of said top inner surface and approximately equal to a fifth radius of said upper portion of said socket.

9. A shelving system as recited in claim 8, wherein said panel is approximately rectangular in shape, said panel having a first edge in the longitudinal direction and a second edge oppositely disposed the first edge in the same direction, said panel further having a first side edge in the transverse direction to the longitudinal first and second edges and a second side edge oppositely disposed the first side edge in the same direction.

10. A shelving system as recited in claim 9, wherein said at least one socket is a first socket disposed proximate said first edge and said first side edge, a second socket disposed proximate said first edge and said second side edge, a third socket disposed proximate said second edge and said second side edge, and a fourth socket disposed proximate said second edge and said first side edge.

11. A shelving system as recited in claim 1, wherein said floor member further includes a plurality of openings through said floor member.

12. A panel as recited in claim 1, wherein said inner wall and said outer wall are substantially concentric.

13. A shelving system comprising:

a plurality of panels, each panel having a longitudinal direction and a transverse direction, said transverse direction being transversely disposed relative to said longitudinal direction, each panel of said plurality comprising:

a plurality of rail members disposed on said panel, said plurality of rail members including a first rail member and a second rail member, said second rail member being disposed adjacent said first rail member, said first rail member having a first upper portion having a first depth, said second rail member having a second upper portion having a second depth, said second depth being greater than said first depth, each rail member of said plurality of rail members further including a lower portion adjacent said upper portion, said lower portion terminating at a curvilinear lower edge;

an inner wall and an outer wall circumscribing said inner wall, said outer wall being distanced from said inner wall, said socket further including a plurality of support members radially disposed and interconnecting said inner wall to said outer wall, and a floor member disposed parallelly relative to said panel and interconnecting said inner wall to said outer wall.

14. A panel for use in a shelving system comprising:

a plurality of sides intersecting at corners, and at least one socket disposed proximate at least one corner of said panel, said socket comprising:

an inner wall and an outer wall, said outer wall surrounding and spaced outwardly from said inner wall;

at least one reinforcement flange interconnecting said inner wall to said outer wall;

a floor member coupled to said inner wall and said outer wall and includes a plurality of openings through said floor member, the floor member being disposed generally parallel relative to the panel, wherein the socket is adapted to transmit stresses along the floor member.

15. A panel as recited in claim 14, wherein said reinforcement flange normally intersects the inner wall and the outer wall.

16. A panel as recited in claim 15, wherein said inner wall and the outer wall are substantially concentric and cylindrical.

17. A panel as recited in claim 16, wherein the reinforcement flange extends in a radial direction from the inner wall to the outer wall.

18. A panel as recited in claim 14, wherein said inner wall has an upper edge and an oppositely disposed lower edge, said floor member is disposed at approximately a midpoint between said upper edge and said lower edge.

19. A panel as recited in claim 14, wherein said panel further includes at least one post member receivable within said socket.

* * * * *